United States Patent [19]

Miyai

[11] Patent Number: 4,545,516

[45] Date of Patent: Oct. 8, 1985

[54] APPARATUS FOR CORRECTING ZIGZAG TRAVEL OF RUNNING SHEET

[75] Inventor: Masuo Miyai, Osaka, Japan

[73] Assignee: Toyo Machinery Co., Ltd., Osaka, Japan

[21] Appl. No.: 640,102

[22] Filed: Aug. 13, 1984

[30] Foreign Application Priority Data

Aug. 19, 1983 [JP] Japan ..... 58-152220

[51] Int. Cl.[4] ..... B65H 25/26

[52] U.S. Cl. ..... 226/20

[58] Field of Search ..... 226/18, 19, 20, 174, 226/190

[56] References Cited

U.S. PATENT DOCUMENTS 2,332,104 10/1943 Meyer ..... 226/20
2,752,151 5/1956 Levine ..... 226/20
3,637,122 1/1972 Tokunaga ..... 226/19 X

FOREIGN PATENT DOCUMENTS 2208703 8/1973 Fed. Rep. of Germany ..... 226/19

*Primary Examiner*—Stuart S. Levy
*Assistant Examiner*—Lloyd D. Doigan
*Attorney, Agent, or Firm*—Larson and Taylor

[57] ABSTRACT

An apparatus comprising a hollow cylindrical member rotatably supported on a shaft, a plurality of guide bars mounted on the cylindrical member as arranged radially therearound and slidable axially thereof, and an annular guide plate supporting one end of each guide bar by a roller so that zigzag travel of a running sheet can be corrected by the axial sliding movement of the guide bars due to an inclination of the guide plate and by the revolution of the guide bars around the shaft. The support point for the inclination of the guide plate is shiftable toward or away from the apparatus.

4 Claims, 6 Drawing Figures

APPARATUS FOR CORRECTING ZIGZAG TRAVEL OF RUNNING SHEET

BACKGROUND OF THE INVENTION

Various apparatus have heretofore been proposed for correcting deviation or zigzag travel of running sheets. For example, an apparatus is known which comprises a hollow cylindrical member rotatably supported on a shaft, a plurality of guide bars mounted on the cylindrical member as arranged radially therearound and slidable each in its axial direction, and an annular guide plate composed of two rings for supporting one end of each guide bar by a bracket and a roller. Zigzag travel of a running sheet can be corrected by the axial sliding movement of the guide bars effected by inclination of the guide plate and revolution of the guide bars around the shaft. An outer peripheral portion of the guide plate is pivotably supported by a support member, while another outer peripheral portion of the guide plate diametrically opposed to the portion is connected to an operating device comprising a cylinder. The guide plate can be inclined about the point where it is pivotably supported, by the advance or retraction of the operating device.

However, the apparatus, in which the support point for the inclination of the guide plate is specified, has the following limitations in correcting zigzag travel of the running sheet.

This type of correcting apparatus generally has responsiveness to immediately correct the position of the running sheet upon deviation of the sheet and also a tendency to act in a sustained fashion, i.e. to gradually correct the position of the sheet in a definite direction. When the support point for the guide plate is remote from the apparatus, the apparatus has high responsiveness, whereas if it is close to the apparatus, the apparatus acts in the sustained fashion.

Nevertheless, when the guide plate has a definite support point for inclination, it is impossible to adjust the responsiveness and the sustained action, with the result that difficulty is encountered in correcting zigzag travel of the running sheet accurately. Further if the support point is set at a remote position for higher responsiveness, there arises the problem that the apparatus becomes bulky and requires a larger space for installation.

SUMMARY OF THE INVENTION

The present invention relates to improvements in apparatus of the type described for correcting zigzag travel of running sheets, and more particularly to an improved apparatus for correcting deviation of the selvage of an elongated fabric, film, paper or like sheet during travel so as to transport the sheet properly along a straight path.

The main object of the present invention is to provide a correcting apparatus of the type described wherein the support point of the annular guide plate for its inclination is indefinite and is virtually shiftable toward or away from the apparatus so that the above-mentioned responsiveness and sustained action can be adjusted properly as desired to accurately correct zigzag travel of a running sheet.

Another object of the invention is to provide an apparatus of the type described which can be installed compactly without entailing any problem of space even when the support point of the guide plate for its inclination is set at a remote position to assure higher responsiveness for the correction of zigzag travel.

More specifically, the present invention provides an apparatus for correcting zigzag travel of a running sheet comprising a hollow cylindrical member rotatably supported on a shaft, a plurality of guide bars mounted on the cylindrical member as arranged radially therearound and slidable axially thereof, and an annular guide plate supporting one end of each guide bar by a roller so that zigzag travel of the running sheet can be corrected by the axial sliding movement of the guide bars due to an inclination of the guide plate and by the revolution of the guide bars around the shaft, the apparatus being characterized in that two nuts are pivoted to side portions of the annular guide plate, a screw rod extending through each of the nuts in screw-thread engagement therewith, separate rotating means being mounted on the two screw rods individually, the two screw rods being rotatable at different speeds due to a difference in rotational speed between the rotating means and thereby made movable different distances to incline the annular guide plate while moving the guide plate axially of the shaft.

With the present apparatus of the foregoing construction, the rotating means mounted on the two screw rods are rotated at different speeds to rotate the screw rods, whereby the nuts screwed on the screw rods are advanced or retracted, consequently advancing or retracting the annular guide plate axially of the shaft. Owing to the difference in rotational speed between the two screw rods, the nut on the screw rod of higher rotational speed moves a larger distance than the other nut. The difference in the moving distance therefore inclines the annular guide plate. Thus, the guide plate is inclined while being advanced or retracted axially of the shaft, whereby the guide bars supported on the guide plate are slidingly advanced or retracted in the axial direction. The running sheet is guided toward the direction of inclination of the guide plate by the sliding movement and by the revolution of the guide bars around the shaft for the correction of deviation or zigzag travel of the running sheet. Furthermore, the responsiveness and sustained action of the apparatus are adjustable by varying the difference in rotational speed between the two screw rods.

According to the present invention, therefore, the support point for the inclination of the guide plate is virtually shiftable away or toward the apparatus by varying the difference in rotational speed between the rotating means for the screw rods, so that the responsiveness and sustained action for correcting zigzag travel can be adjusted properly as desired. This assures correction with high accuracy. Moreover, even if the support point for the inclination of the guide plate is set at a remote location, the apparatus can be installed compactly without entailing any problem of space.

DESCRIPTION OF THE PREFERRED EMBODIMENTS

Figure 1:
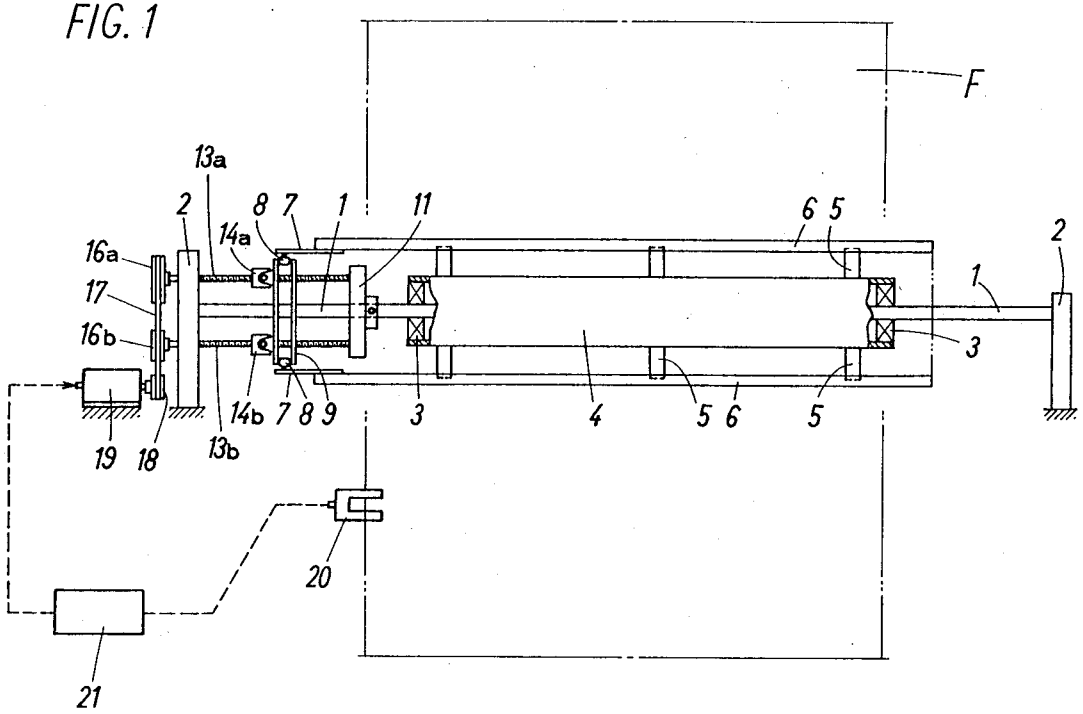
FIG. 1 is a front view schematically showing a preferred embodiment of the invention in its entirety.

With reference to FIGS. 1 to 5, a shaft 1 is fixed to brackets 2. A hollow cylindrical member 4 is rotatably mounted by rotary bearings 3 on the shaft 1. At a plurality of portions on the outer periphery of the cylindrical member 4, slide bearings 5 are arranged radially, and guide bars 6 each slidable axially thereof are mounted on the slide bearings 5 as arranged radially around the member 4. One end of each guide bar 6 has a bracket 7 carrying a roller 8. An annular guide plate 9 comprises two rings spaced apart by a required distance and connected together. The rollers 8 are provided in the space between the rings of the plate 9 and are arranged along a circle, whereby the guide bars 6 are supported, each at its one end, by the annular guide plate 9. Thus, by means of the rollers 8, the guide bars 6 are revolvable around the shaft 1 with the rotation of the cylindrical member 4.

Two connecting members 10*a*, 10*b* are mounted on the outer side surface of the annular guide plate 9 at locations diametrically opposed to each other. Nuts 14*a*, 14*b* are pivoted to the connecting members 10*a*, 10*b* by pins 15*a*, 15*b*. The nuts 14*a*, 14*b* are respectively screwed on two screw rods 13*a*, 13*b* extending through the annular guide plate 9 axially of the shaft 1 and rotatably supported by a bracket 11 and bearings 12 on the bracket 2.

Figure 5:
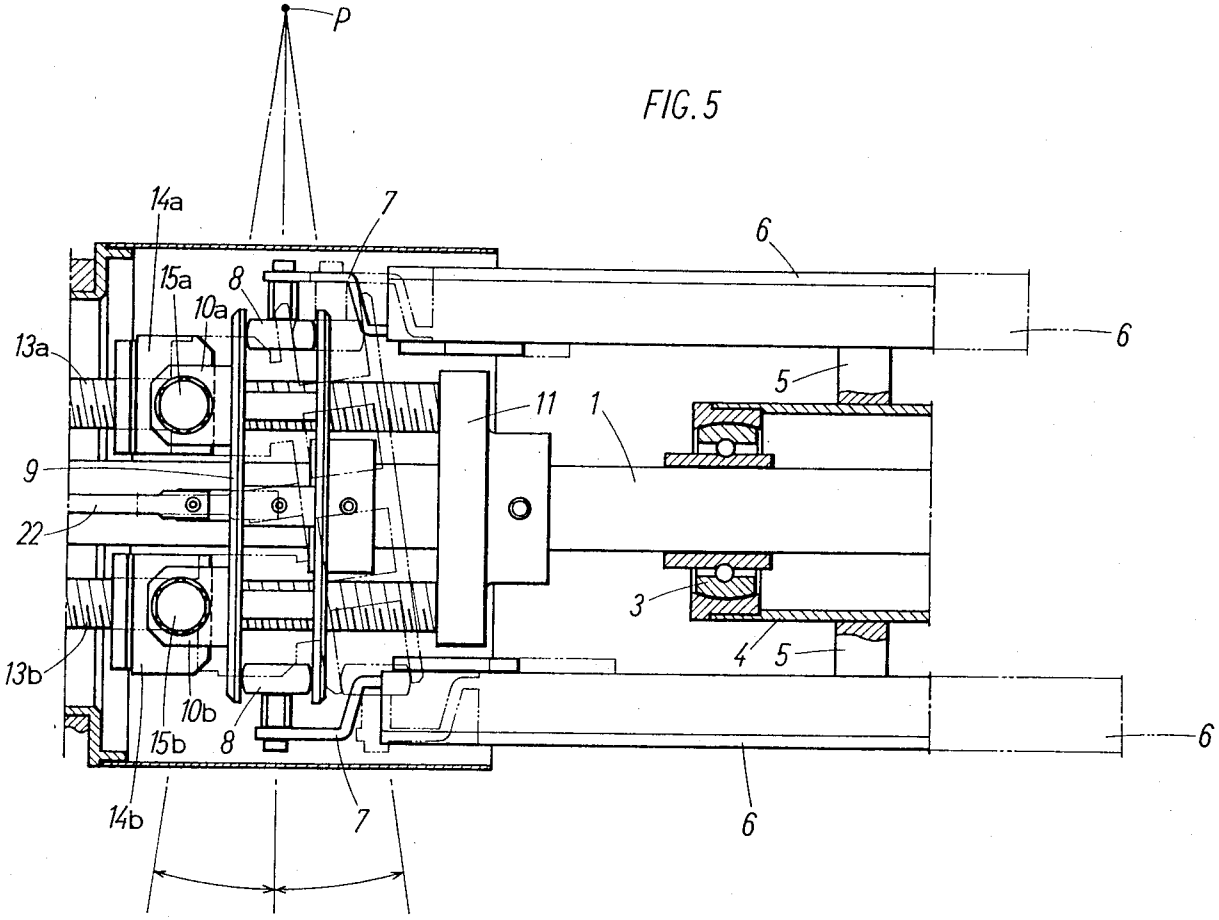
FIG. 5 is a diagram for illustrating the operation of an annular guide plate.

To render the annular guide plate 9 smoothly inclinable, for example, as turned about a point P shown in FIG. 5, it is desirable to form slots (not shown) in the connecting members 10*a*, 10*b* and insert the pins 15*a*, 15*b* through the slots for pivoting the nuts 14*a*, 14*b* to the connecting members 10*a*, 10*b*, respectively.

Figure 2:
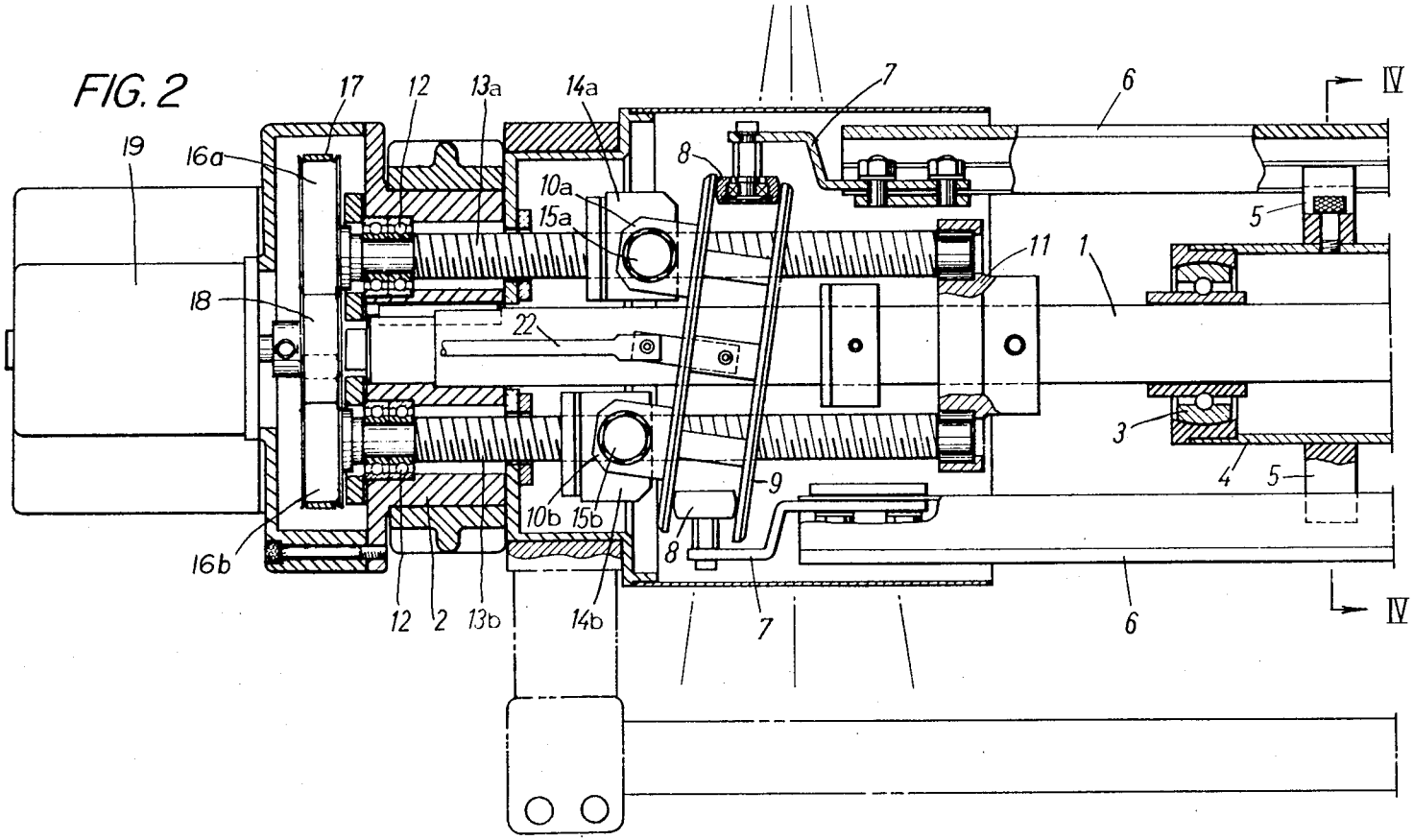
FIG. 2 is a fragmentary enlarged view in section showing the same.
Figure 3:
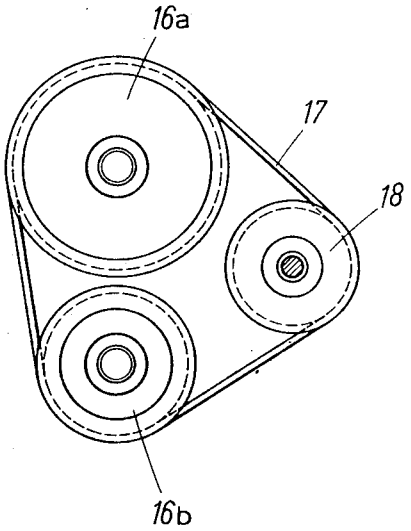
FIG. 3 is a side elevation showing a timing pulley assembly.
Figure 4:
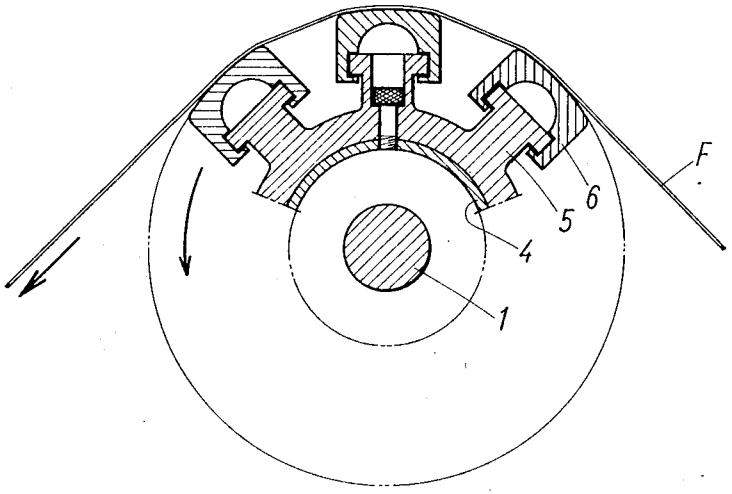
FIG. 4 is a view in section taken along the line IV—IV in FIG. 2 and partly broken away.

The screw rods 13*a*, 13*b* are provided at their outer ends with separate rotating means which are in the form of two timing pulleys 16*a*, 16*b* having different diameters. According to the present embodiment, the timing pulley 16*a* on the screw rod 13*a* is larger in diameter. Through a timing belt 17, the timing pulleys 16*a*, 16*b* are driven by a reversible servomotor 19 having another timing pulley 18. For rotation, the servomotor 19 is controlled by a control circuit 21 which receives signals from a sensor 20 for detecting the position of a selvage of a running sheet F (FIG. 1) as already known. According to the present embodiment, the screw rods 13*a*, 13*b* are handed in the same direction and are identical in thread pitch, so that when the rods 13*a*, 13*b* are rotated by the rotation of the servomotor 19 through the pulleys 16*a*, 16*b*, the screw rod 13*b* rotates at a higher speed than the other rod 13*a* because the pulleys 16*a*, 16*b* differ in diameter and therefore in rotational speed. Consequently the nut 14*b* moves a larger distance than the nut 14*a*, inclining the guide plate 9 rightward or leftward while moving the plate 9 in either direction as seen in FIGS. 2 and 5.

When the guide plate 9 is moved and inclined in response to signals from the sensor 20 as above, the guide bars 6 arranged radially around the hollow cylindrical member 4 as if forming a roll slide axially thereof while being revolved around the member 4, so that the running sheet in a deviated position is moved transversely or sidewise to the proper position by the sliding guide bars 6. Thus the deviation of the running sheet is corrected as desired. Indicated at 22 is a rod for limiting the inclination of the annular guide plate 9.

Figure 6:
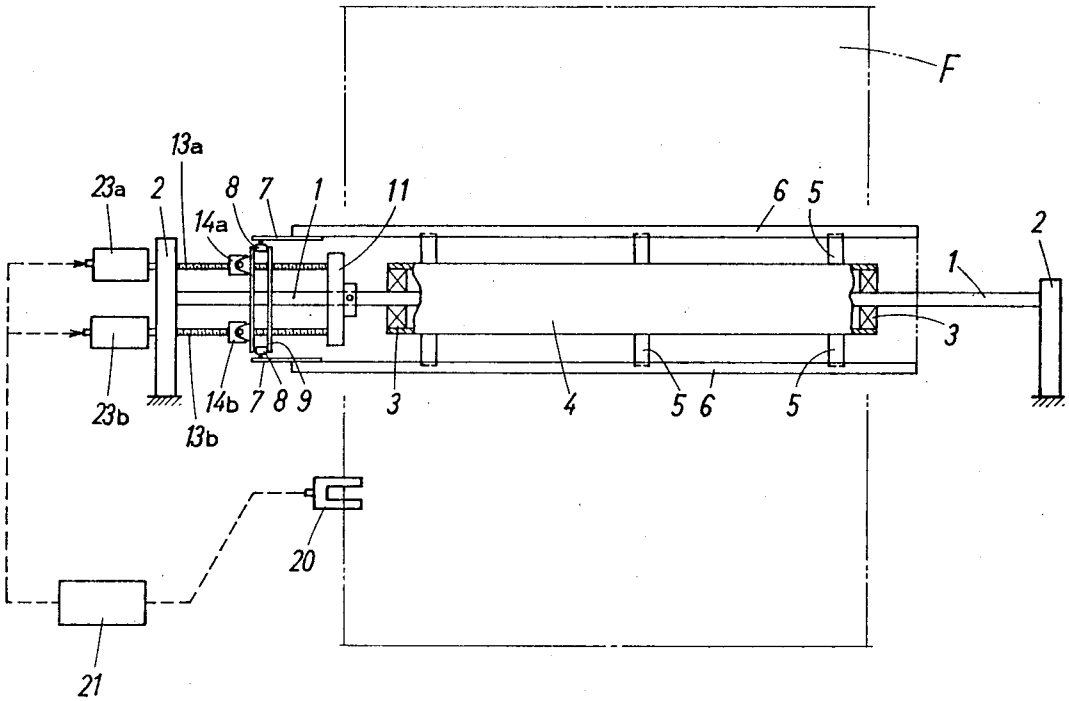
FIG. 6 is a front view schematically showing the entire apparatus which, however, is provided with modified rotating means for screw rods.

FIG. 6 shows other rotating means for the screw rods 13*a*, 13*b* of the present apparatus. Instead of using the timing pulleys of different diameters, reversible servomotors 23*a*, 23*b* are mounted on the screw rods 13*a*, 13*b* for individually rotating the rods at different speeds.

The present invention is not limited to the foregoing embodiments which are given for illustrative purposes only but can be modified variously without departing from the scope of the invention defined in the appended claims.

What is claimed is:

1. An apparatus for correcting zigzag travel of a running sheet comprising a hollow cylindrical member rotatably supported on a shaft, a plurality of guide bars mounted on the cylindrical member as arranged radially therearound and slidable axially thereof, and an annular guide plate supporting one end of each guide bar by a roller so that zigzag travel of the running sheet can be corrected by the axial sliding movement of the guide bars due to an inclination of the guide plate and by the revolution of the guide bars around the shaft, the apparatus being characterized in that two nuts are pivoted to side portions of the annular guide plate, a screw rod extending through each of the nuts in screw-thread engagement therewith, separate rotating means being mounted on the two rods individually, the two screw rods being rotatable at different speeds due to a difference in rotational speed between the rotating means and thereby made movable different distances to incline the annular guide plate while moving the guide plate axially of the shaft.

2. An apparatus as defined in cliam 1 wherein the rotating means for the two screw rods are timing pulleys having different diameters and mounted on the screw rods individually, and the screw rod having the pulley of the smaller diameter is rotatable at a higher speed than the other screw rod having the pulley of the larger diameter through a timing belt by the rotation of a motor provided with another timing pulley, whereby the two screw rods are made movable different distances to incline the annular guide plate while moving the guide plate axially of the shaft.

3. An apparatus as defined in claim 1 wherein the rotating means for the two screw rods are motors mounted on the screw rods individually, the two screw rods being rotatable at different speeds due to a difference in rotational speed between the motors and thereby made movable different distances to incline the annular guide plate while moving the guide plate axially of the shaft.

4. An apparatus as defined in claim 2 wherein the motor is a reversible servomotor.

* * * * *